US006854978B2

(12) United States Patent
Noirjean

(10) Patent No.: US 6,854,978 B2
(45) Date of Patent: Feb. 15, 2005

(54) PORTABLE ELECTRONIC DEVICE INCLUDING MEANS FOR ESTABLISHING AN ELECTRICAL CONNECTION INSIDE A CASE OF SAID DEVICE

(75) Inventor: Pierre-André Noirjean, Develier (CH)

(73) Assignee: Eta Sa Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 10/693,893

(22) Filed: Oct. 28, 2003

(65) Prior Publication Data

US 2004/0084200 A1 May 6, 2004

(30) Foreign Application Priority Data

Oct. 28, 2002 (EP) ..... 02079509

(51) Int. Cl.[7] ..... H01R 33/00
(52) U.S. Cl. ..... 439/37; 343/718; 368/282
(58) Field of Search ..... 439/37; 343/718; 368/282

(56) References Cited

U.S. PATENT DOCUMENTS

| | | | | | |
|---|---|---|---|---|---|
| 4,194,355 | A | * | 3/1980 | Nishida | 368/282 |
| 4,947,179 | A | | 8/1990 | Ganter et al. | |
| 5,168,281 | A | | 12/1992 | Tokunaga | |
| 5,179,733 | A | * | 1/1993 | Matsui | 455/344 |
| 5,189,431 | A | * | 2/1993 | Marinelli | 343/718 |
| 5,280,296 | A | * | 1/1994 | Tan et al. | 343/718 |
| 5,450,091 | A | * | 9/1995 | Hama | 343/718 |
| 5,465,098 | A | * | 11/1995 | Fujisawa et al. | 343/718 |
| 5,499,292 | A | * | 3/1996 | Blonder et al. | 379/433.1 |
| 5,499,398 | A | * | 3/1996 | Kudoh et al. | 455/290 |
| 5,526,006 | A | * | 6/1996 | Akahane et al. | 343/718 |
| 5,532,705 | A | * | 7/1996 | Hama | 343/718 |
| 5,564,082 | A | * | 10/1996 | Blonder et al. | 455/575.6 |
| 5,564,096 | A | * | 10/1996 | Hama et al. | 455/300 |
| 5,589,840 | A | * | 12/1996 | Fujisawa | 343/718 |
| 5,615,179 | A | * | 3/1997 | Yamamoto et al. | 368/281 |
| 5,627,552 | A | * | 5/1997 | Farrar et al. | 343/718 |
| 5,699,319 | A | * | 12/1997 | Skrivervik | 368/10 |
| 5,737,699 | A | * | 4/1998 | Farrar et al. | 455/344 |
| 5,742,256 | A | * | 4/1998 | Wakabayashi | 343/718 |
| 5,768,217 | A | * | 6/1998 | Sonoda et al. | 368/10 |
| 5,790,477 | A | * | 8/1998 | Hauke | 368/10 |
| 5,864,061 | A | * | 1/1999 | Dilz, Jr. | 73/488 |
| 5,886,669 | A | * | 3/1999 | Kita | 343/718 |
| 5,889,737 | A | * | 3/1999 | Alameh et al. | 368/204 |
| 5,986,566 | A | * | 11/1999 | Yamamori | 340/7.63 |

(List continued on next page.)

FOREIGN PATENT DOCUMENTS

| | | | |
|---|---|---|---|
| EP | 631 341 | A1 | 12/1994 |
| EP | 867 968 | A2 | 9/1998 |
| EP | 1 315 051 | A1 | 11/2001 |
| EP | 1 315 234 | A1 | 11/2001 |
| EP | 1 315 265 | A1 | 11/2001 |

*Primary Examiner*—Ross Gushi
(74) *Attorney, Agent, or Firm*—Sughrue Mion, PLLC

(57) ABSTRACT

There is described a portable electronic device of the wristwatch type including, in particular, a first electric module (32), arranged in a case (20) of the device and a second electric module (13, 22) housed in a strand (1) of the wristband and including means (11) for and electric connection with the first electric module. The case (20) of the device has two main parts, a bottom portion (24) and a top portion (23). The present invention provides means (8, 27) for introducing the connecting means (11) inside the case (20), and means (36, 44) for establishing the electrical connection between said connecting means (11) and bump contacts (33) of the first electric module (32), via compression, when the two portions (23, 24) of the case (20) are mounted.

14 Claims, 5 Drawing Sheets

U.S. PATENT DOCUMENTS 6,079,269 A * 6/2000 Dilz, Jr. ..... 73/488
6,155,841 A * 12/2000 Spanyar ..... 439/37
6,175,729 B1 * 1/2001 He et al. ..... 455/344
6,192,253 B1 * 2/2001 Charlier et al. ..... 455/575.7
6,239,759 B1 * 5/2001 Appelkvist et al. ..... 343/718
6,329,903 B1 * 12/2001 Yamamori ..... 340/7.63
6,350,055 B1 * 2/2002 Barras ..... 368/281
6,366,250 B1 * 4/2002 McConnell ..... 343/718
6,396,144 B1 * 5/2002 Koyama ..... 257/728
6,411,569 B1 * 6/2002 Megner et al. ..... 368/43
6,412,976 B1 * 7/2002 Dechery et al. ..... 368/281
6,454,608 B1 * 9/2002 Kitahara et al. ..... 439/638
6,459,890 B1 * 10/2002 Kim ..... 455/351
6,484,947 B1 * 11/2002 Miyata ..... 235/492
6,535,376 B2 * 3/2003 Fujita et al. ..... 361/625
6,619,835 B2 * 9/2003 Kita ..... 368/281
6,634,786 B2 * 10/2003 Dinger et al. ..... 368/283

* cited by examiner

PORTABLE ELECTRONIC DEVICE INCLUDING MEANS FOR ESTABLISHING AN ELECTRICAL CONNECTION INSIDE A CASE OF SAID DEVICE

BACKGROUND OF THE INVENTION

The present invention concerns a portable device including a case in which there is arranged a first electric module, and a wristband or bracelet attached to the case, the case including a top portion and a bottom portion which cooperate with each other in order to assemble the case, a second electric module being associated with the wristband and electric connecting means providing an electrical connection between the first and second electric modules through an aperture arranged in the case, the first electric module including at least one electric bump contact capable of being connected to the electric connection means.

More particularly, the present invention concerns a portable device of this type including means for establishing contact between the electrical connection means and the first electric module, inside the case, in a removable manner.

In the present description, "electrical connection means" means any conductor or set of conductors enabling an electrical connection to be made between two electric modules. Likewise, "electric module" means any device for providing or receiving an electric supply and, if necessary, transmitting or receiving an electric signal.

In a preferred embodiment, the portable electronic device is made in the form of a portable electronic instrument taking the shape of a wristwatch including means for receiving and possibly transmitting radio frequency type signals. In such case, the first electric module includes electronic processing circuits for the electric signals exchanged with the second electric module, the latter including an antenna.

Such portable devices have already been disclosed in the prior art proposing various solutions concerning the means for securing the electric connecting means to the first electric module.

European Patent No. 0 631 341 discloses an electronic instrument of the wristwatch type including an antenna housed in the wristband and connected to electronic circuits for processing the signals received by the antenna. The electronic processing circuits are arranged inside the case of the instrument on a printed circuit board. Bump contacts are arranged on a peripheral region of the printed circuit board for establishing an electrical connection between the connection terminals of the antenna and the electronic processing circuits. The solution disclosed in this document for providing the electric connection between the antenna terminals and the bump contacts of the printed circuit board consists in using fixing screws passing through suitable openings, arranged in the antenna terminals, and screwed into the printed circuit board in the vicinity of the bump contacts.

This solution has, however, certain drawbacks, particularly when the electronic instrument is assembled, in that it is necessary to provide holes in the printed circuit board for receiving the screws and in that a screwing step is indispensable. Moreover, any subsequent replacement of the antenna in the event of a problem means that the instrument case has to be completely dismantled, before the fixing screws can be accessed, which can make this operation awkward.

A different solution for providing the connection between the antenna terminals and the electronic processing circuits is set out in the same Patent in the presentation of the prior art. This alternative is based on the use of a leaf spring type connector, for each antenna terminal, onto which an electrical conductor, connected to one of the antenna terminals, is pressed.

Such an embodiment makes assembling the wristband and the antenna easier than in the solution previously described, in that the electrical conductor need only be plugged into an opening in the case in order to establish the electric contact.

However, this solution also has drawbacks, in particular from the point of view of its durability over time. Indeed, the leaf spring is typically welded onto the printed circuit board, which has to be carried out with care to guarantee sufficient mechanical resistance with respect to the perpendicular stress exerted on the spring, once the electrical conductor is placed pressing against it. It should also be noted that the contact surfaces between the spring and the electrical conductor are not protected, which can lead to stability problems for the electrical connection, due particularly to possible oxidation of the free metal surfaces. Moreover, this solution is relatively bulky and consequently cannot be suitable for making an instrument of small volume.

SUMMARY OF THE INVENTION

It is an object of the present invention to improve the electronic devices of the aforementioned type in order to avoid the aforecited drawbacks.

The invention therefore provides a portable device of the type indicated hereinbefore, characterized in that the assembly of the case ensures an electrical contact, by compression, between said connecting means and said bump contact.

Moreover, securing means are providing for holding the bottom and top portions of the case together, such as screws for example, implementation of these securing means guaranteeing that the connecting means and the bump contact are held in contact.

Owing to the structure according to the present invention, the second electric module housed in the wristband of the portable device can be disconnected from the first electric module simply by releasing the two portions of the case from each other. The fact of moving the two portions of the case away from each other relieves the pressure respectively exerted on the connecting means of the second electric module and on the bump contact of the first electric module.

In a preferred embodiment of the present invention, the portable electronic device is an instrument of the wristwatch type having communication means using radio frequency waves. An antenna is thus housed in the wristband, connected to electronic processing circuits for the signals received by the antenna, these circuits being arranged in the instrument case.

In this case, electric conductors are also provided for connecting the two terminals of the antenna to the electronic processing circuits, the conductors being arranged through an opening in the instrument case. When the antenna is set in place, electric conductor regions are brought opposite the bump contacts arranged on a printed circuit board carrying the electronic processing circuits.

Means are then provided for compressing these electrical conductor regions against the bump contacts when the bottom and top portions of the case are assembled.

These means may simply be made in the form of feet manufactured in a single piece, respectively, with the bottom and top portions of the case and located opposite the printed circuit board bump contacts.

According to a preferred embodiment, additional means are provided for compressing the connecting means against the bump contacts.

Owing to the features of the invention, it is not necessary to completely dismantle the case in order to dismantle the wristband and the antenna. Moreover, the connection of the antenna to the electronic processing circuits is reliable and durable overtime.

BRIEF DESCRIPTION OF THE DRAWINGS

The invention will be better understood with reference to the following description of two embodiment examples referring to the annexed drawings, in which.

DETAILED DESCRIPTION OF THE INVENTION

The embodiments described concern a particular portable electronic device by way of non-limiting example, namely an instrument of the wristwatch type with at least radio frequency wave receiving functions.

Figure 1:
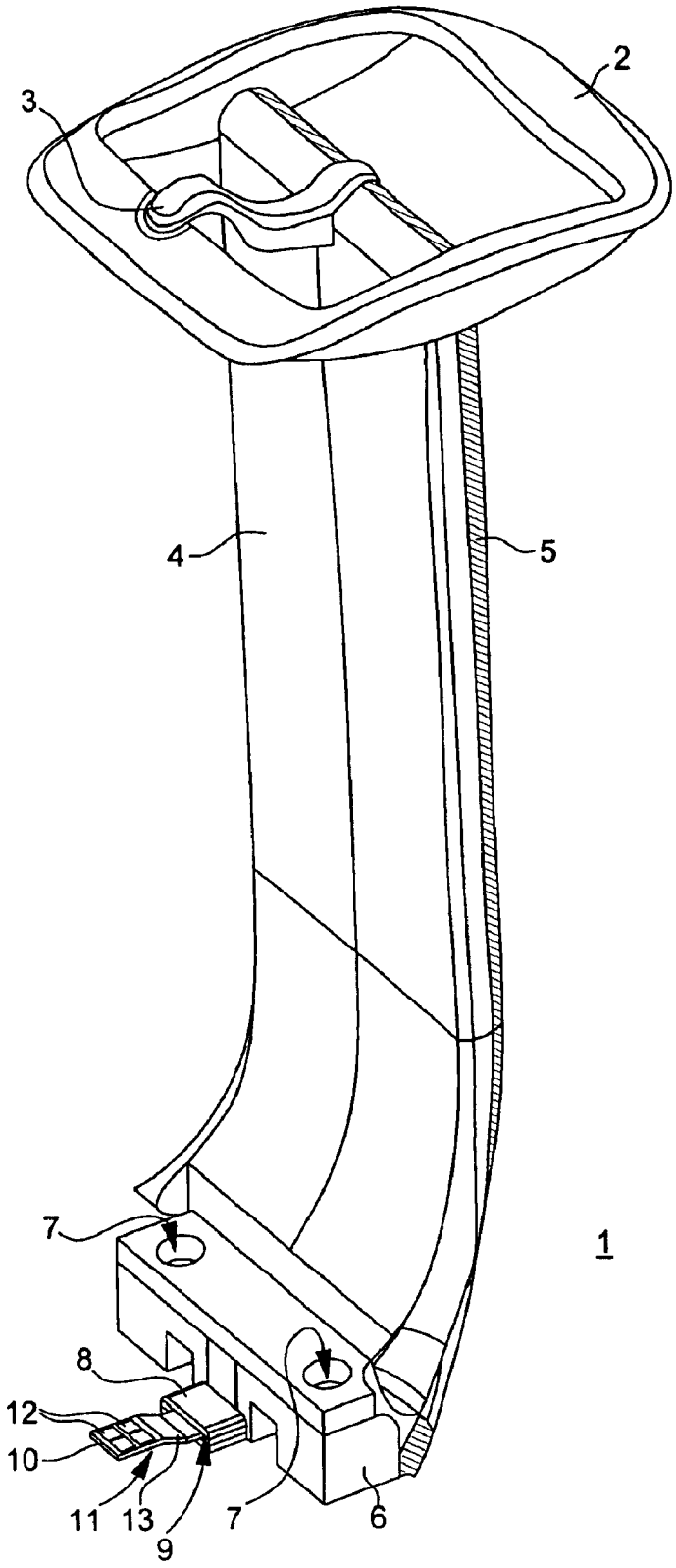
FIG. 1 is a perspective view of the wristband provided for the portable device according to a preferred embodiment of the present invention.

FIG. 1 shows a preferred embodiment of strand 1 of the wristband according to the present invention carrying buckle 2 with its tongue 3. The wristband is obtained by moulding plastic materials and has a conventional external appearance. It can be seen in FIG. 1 that the strand 1 shown includes three main constituent elements. Strand 1 is obtained by an assembly of two "half-strands" in its thickness, a first inner half-strand 4 and a second outer half-strand 5. The third constituent element of the strand is a reinforcing element 6, arranged at the end of strand 1 for connection to the watchcase. Reinforcing element 6 is made of a plastic material having greater rigidity than that of the materials chosen for manufacturing half-strands 4 and 5, so as to guarantee a solid connection between the case and strand 1. Holes 7 are provided in reinforcing element 6 and in inner half-strand 4 to receive screws (not shown) fixing strand 1 to the watchcase.

It will also be noted that a snug 8, whose function will be explained hereinafter, is arranged at the end of strand 1 intended to be connected to the watchcase. Preferably, snug 8 is made in a single piece with inner half-strand 4, by a conventional moulding technique, and includes a central hole 9.

Free end 10 of electrical connecting means 11 is apparent, the connecting means protruding from strand 1 from central hole 9 of snug 8. These connecting means 11 are provided particularly for connecting the terminals of an antenna (visible in FIG. 2) arranged between the two half-strands 4 and 5 of the wristband when they are assembled. Connecting means 11 include, in particular, conductive paths (not shown) whose ends are shaped into contact pads 12, the paths being carried by a flexible substrate 13.

Figure 2:
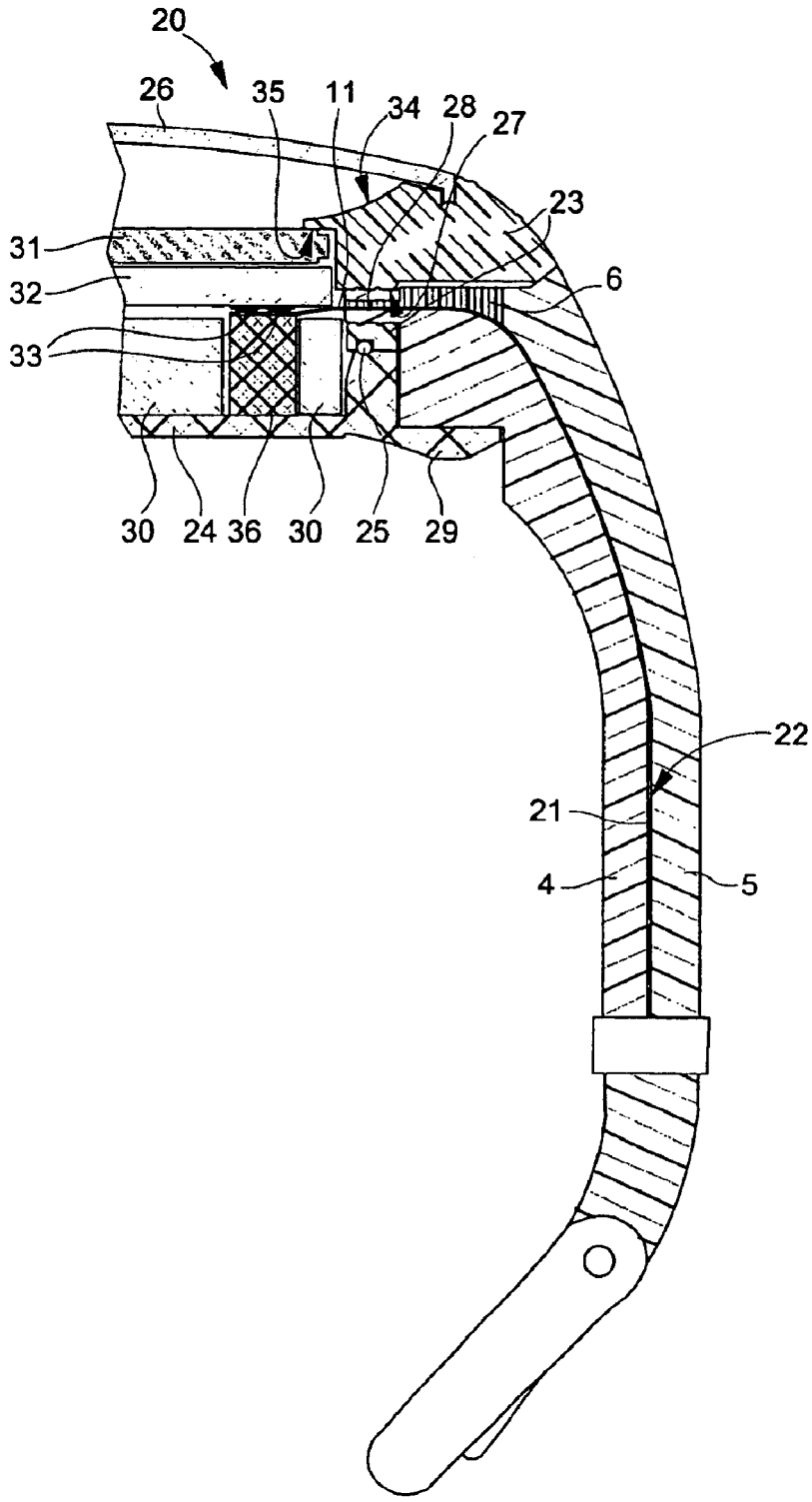
FIG. 2 is a partial schematic cross-section of the portable device according to a first embodiment of the present invention.

FIG. 2 is a partial cross-section of strand 1 of the wristband assembled on case 20 of the instrument in accordance with a first embodiment of the invention. The diagram has been deliberately simplified in order to make the particular features of the present invention appear more clearly.

It can be seen in FIG. 2, that strand 1 includes, between its two half-strands 4 and 5, a substrate 13 carrying an antenna 22. Preferably, the type of antenna used has a conductive path in the shape of a spiral deposited on a flexible substrate. Reference could be made in particular to the content of European Patent Application No. 01204565.4 by the same Applicant, entitled "Antenne de reception d'ondes VHF logée dans un bracelet de dispositif électronique portable" for all the details concerning antenna 22.

Instrument case 20 mainly includes a top portion, or middle part, 23, and a bottom portion, or back cover, 24, the middle part and the back cover being separated by a sealing gasket 25 making case 20 water resistant. The case is also closed on the top by a glass 26, of conventional type, made for example of plastic or sapphire depending on the desired quality range.

Middle part 23 has an opening 27 on its side in which snug 8 of wristband strand 1 is inserted. Consequently, the transverse dimensions of snug 8 are preferably chosen to be slightly greater than those of opening 27. Thus, snug 8 is friction fitted in opening 27 and itself makes the case water resistant at the opening. This construction detail advantageously means that the use of an additional sealing gasket at this location can be omitted for introducing connecting means 11 of antenna 22 inside case 20. Beads of material (not shown) moulded with snug 8 can also be provided to guarantee water resistance at opening 27.

It will also be noted that reinforcing element 6 has a thin portion 28 extending inside central hole 9 of snug 8, pressed against antenna connecting means 11, thus guaranteeing a certain rigidity for snug 8, any deformation of which could be detrimental from the point of view of the instrument's water resistance. It may also be noted that any deformation of snug 8 is capable of damaging antenna 22, which is avoided here.

Peripheral portion 29 of back cover 24 has a complementary shape to that of the end of inner half-strand 4 intended to be secured to instrument case 20. Likewise, middle part 23 has a substantially complementary shape to that of the portion of strand 1 intended to be arranged opposite middle part 23. Thus, strand 1 is wedged between middle part 23 and back cover 24. As was seen in relation to FIG. 1, screws are provided for fixing strand 1 to case 20. It may be noted that, according to a preferred alternative, these screws also pass through holes (not shown) arranged in back cover 24, on its peripheral portion 29, to allow case 20 to be assembled.

Case 20 encloses electronic circuits 30 controlling, in particular, display means, schematised in FIG. 2 by a liquid crystal display or LCD screen 31. Electronic circuits 30 can also include means ensuring various additional functions, such as a conventional clockwork movement for example, to allow a current time display. Of course, a power source (shown with the reference 48 in FIG. 5) is provided for powering the various components of the instrument according to the invention.

Electronic circuits 30 are also electrically connected to a first electric module 32 including, in the illustrated example, electronic circuits for processing the signals received by antenna 22. The first electric module includes bump contacts 33 provided to be put in contact with contact pads 12 of antenna 22.

Of course, a single electronic circuit grouping together all of electronic circuits 30, can be provided, including the clockwork movement, and electric module 32 with its electronic signal processing circuits.

Various conventional means are provided for positioning the various components present in case 20. It can be seen in particular that middle part 23 includes a bead 34 with a shoulder 35 against which LCD screen 31 presses. Likewise, electric module 32 presses against LCD screen 31, either directly, or via additional elements (not shown), possibly of the spacer type. Moreover, peripheral regions of certain components arranged in middle part 23 can be stopped against regions of the latter, as is the case of electric module 32 in FIG. 2.

Legs can also be provided, only one 36 of which is shown schematically in FIG. 2, for positioning electronic circuits 30. Preferably, electronic circuits 30 are carried by a printed circuit board (not shown) including through holes at various places, provided for cooperating with the positioning legs, this structure being known.

However, within the scope of the present invention, leg 36 has a second function in addition to its conventional function of positioning the electronic circuits. Indeed, it is apparent from FIG. 2 that, when case 20 of the portable device is mounted, end 10 of connecting means 11 is compressed by leg 36 against bump contacts 33 of first electric module 32.

Thus, simply the assembly of the top portion, i.e. middle part 23, and the bottom portion, i.e. back cover 24, causes an electric connection to be established between a first and second electric module, i.e. here electronic signal processing circuits 32 and an antenna 22. Specific means for establishing this electric connection, such as a weld or a screw are not necessary, unlike all that is known from the prior art. Likewise, the step of setting in place such means for establishing the electrical connection, during assembly of the case, is advantageously omitted.

An additional advantage of the structure according to the present invention results from the fact that the first electric module 32 and snug 8 of the wristband, thus end 10 of connecting means 11, are positioned with respect to a single same reference, namely middle part 23. Consequently, a high level of reliability can be obtained during assembly in the arrangement of these components, in that it does not depend upon tolerances on the dimensions or positioning of other components of case 20.

As regards leg 36, this is preferably made at the same time as the back cover by moulding plastic or metal material. Alternatively, it could be made in the shape of a tube into which there is forcibly inserted an additional element, the face of which intended to come into contact with end 10 of connecting means 11 is substantially planar and covers a surface at least equal to that of bump contacts 33. Preferably, this additional element is elastic such that the aforementioned face can be deformed to guarantee a good quality of contact between connecting means 11 and bump contacts 33.

Figure 3:
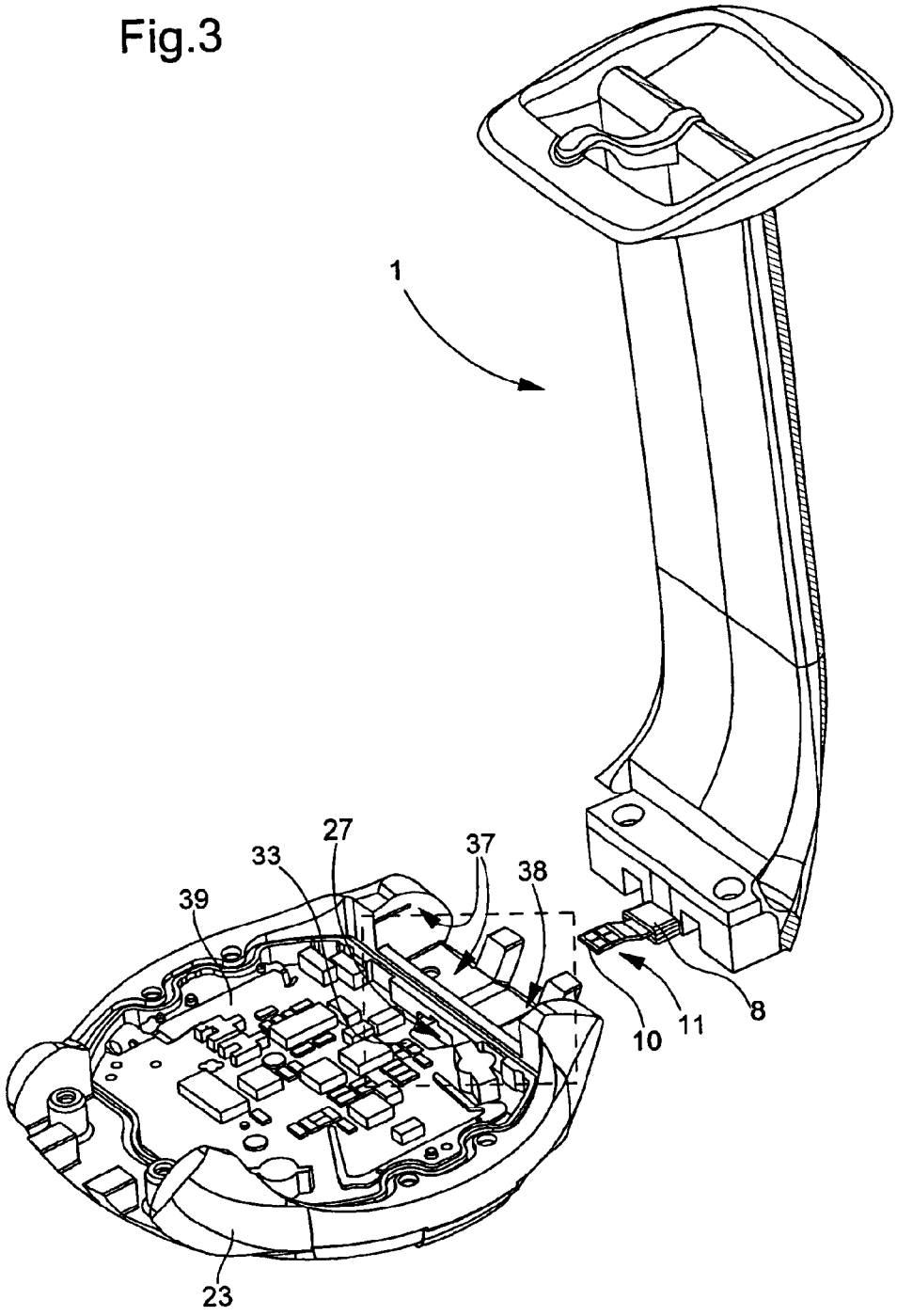
FIG. 3 is a perspective view of the portable device according to a second embodiment of the present invention, without the bottom portion of the case.

FIG. 3 shows in perspective a portion of the portable device according to a second preferred embodiment of the present invention. Wristband strand 1 previously described in relation to FIG. 1 is found again in this Figure. There is also shown a bottom view of a middle part 23 similar to that described with reference to FIG. 2, and in which only part of the components provided in case 20 is visible. At the stage illustrated in FIG. 3, strand 1 is ready to be set into place on middle part 23.

It can be seen, in this view, that middle part 23 includes a plurality of guide surfaces 37 for cooperating with surfaces at the end of strand 1 intended to be secured to case 20. It can be seen in particular that middle part 23 includes a surface 38 of complementary section to approximately half of that of snug 8 and consequently providing a radial guide function for strand 1.

FIG. 3 also shows, facing guide surface 38, opening 27 of middle part 23 intended to receive snug 8 of strand 1 to allow the introduction of connecting means 11 of antenna 22 into case 20 of the portable device.

In this embodiment, the set of electronic circuits of the portable device is arranged on a printed circuit board or PCB 39, which is the case in particular of first electric module 32. However, since the arrangement of these electric circuits does not form a central part of the present invention, it will not be described in any more detail. It should be noted that in a preferred variant, said circuits can include horological type circuits allowing the portable device to have time functions in addition to its specific functions linked to the radiowave communication means.

As the other elements visible in FIG. 3 do not have any direct link to the problem resolved by the invention, they will not be examined here since those skilled in the art will not have any particular difficulty in implementing them.

Figure 4A:
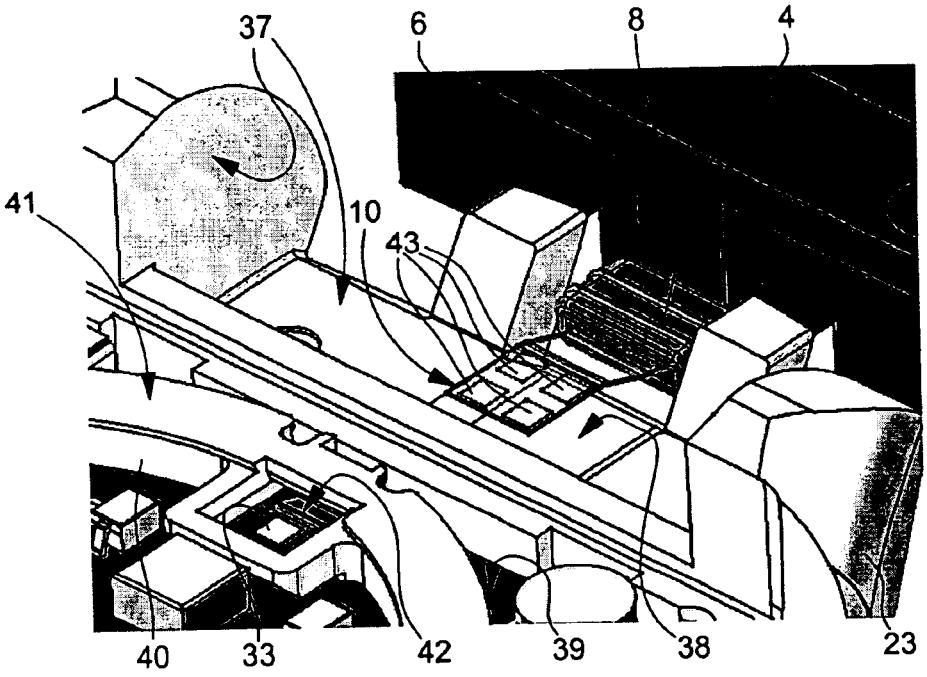
FIGS. 4*a* to 4*c* are enlarged views of the framed part of FIG. 3 showing successive steps for placing the electric connecting means of the second electric module in the top portion of the case and establishing the electric contact with the first electric module.
Figure 4B:
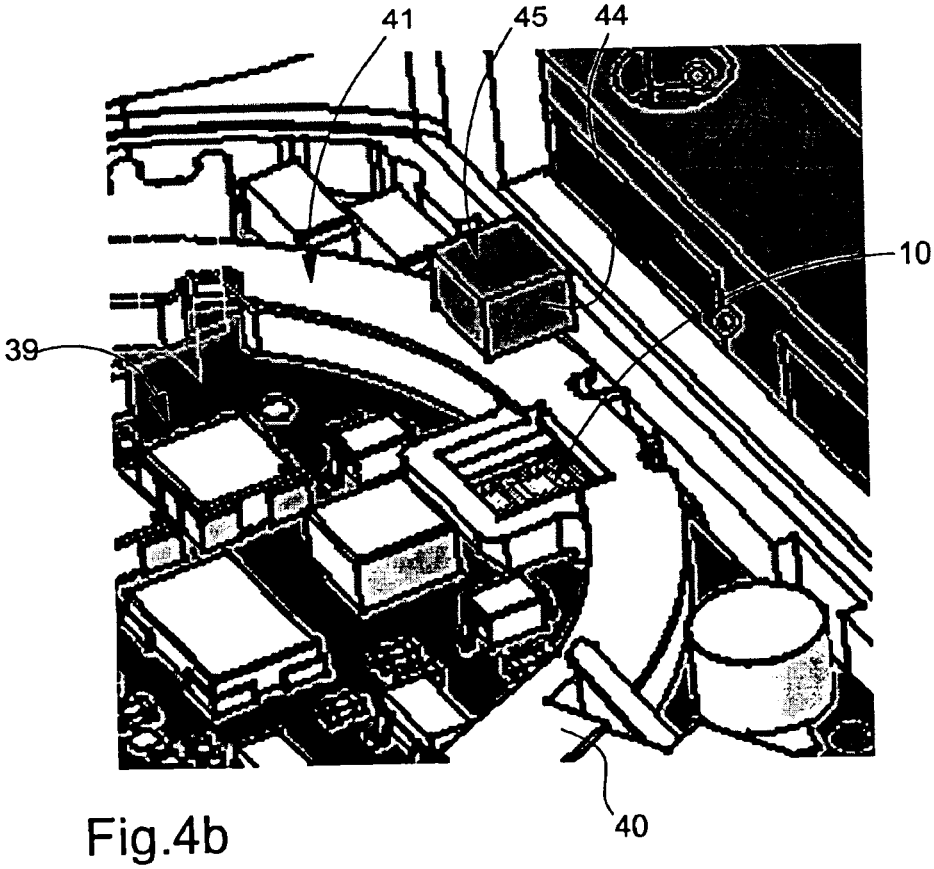
Figure 4C:
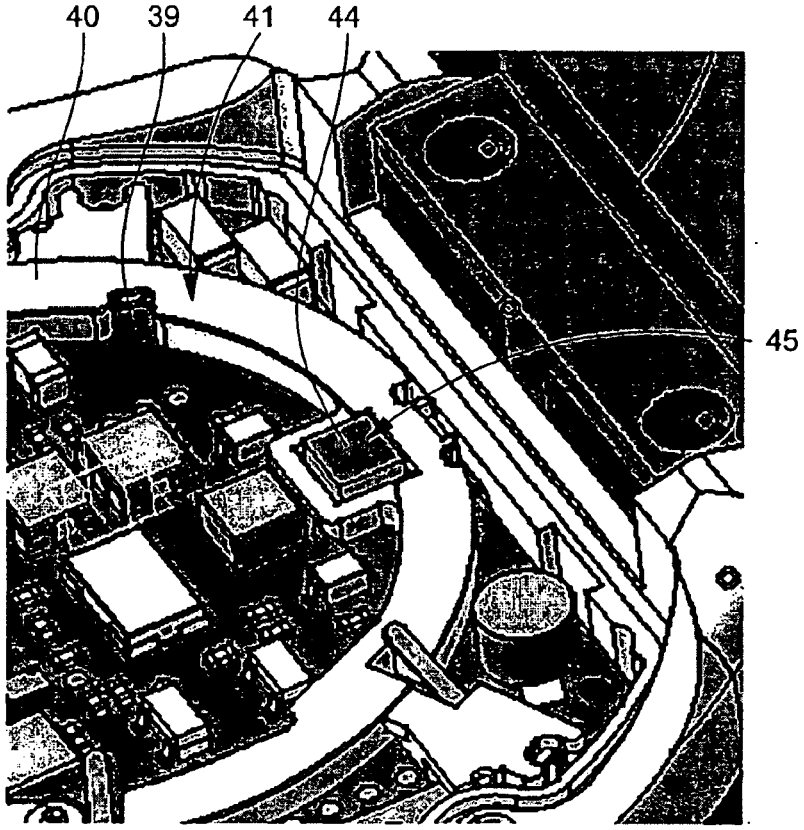

FIGS. 4*a* to 4*c* show better the particular details linked to the connection of the two electric modules, namely the antenna and the electronic circuits processing the electric signals received by said antenna.

FIG. 4*a* shows a similar view to that of FIG. 3, one part of which has been enlarged, wristband strand 1 being closer to middle part 23.

Between these two Figures, it will be noted that a spacer 40 has been added, abutting PCB 39, its main function being to provide a support surface 41, for the subsequent assembly steps, located in a substantially parallel plane to the plane of PCB 39 and at a greater distance than the height of the highest electronic component carried by the PCB.

Spacer 40 includes a housing 42 whose function will be explained hereinafter, in relation to the description of FIGS. 4*b* and 4*c*. The transverse dimensions of housing 42 are substantially greater than the dimensions of the set of bump contacts 33 so as to make the latter accessible through the housing.

It should be noted, in FIG. 4*a*, that end 10 of connecting means 11 has four contact pads 43. Indeed, as mentioned hereinbefore, the second electric module housed in strand 1 can have a plurality of function. Thus, two 12 of contact pads 43 are used to connect the terminals of antenna 22 to the electronic circuits arranged in case 20, whereas the two remaining contact pads 43 can be used to connect another component. By way of example, means for charging a battery used as a power source for the portable device according to the invention and capable of establishing a conventional, ohmic, capacitive or inductive type contact with a suitable charger, could be provided. In the case of inductive type charging means, a charging coil (not shown) will also be arranged on substrate 13, whose ends are connected to the remaining contact pads 43.

Those skilled in the art interested in the additional functions could refer in particular to the content of European Patent Applications Nos. 01204557.1 and 01204691.8 filed by the same Applicant.

FIGS. 4*b* and 4*c* show the setting in place of a substantially parallelepiped buffer 44 in housing 42 of spacer 40, after strand 1 has been deposited against middle part 23, thus after connecting means 11 have been introduced inside case 20.

Buffer 44, preferably made of an elastic material such as rubber for example, is simply deposited inside housing 42, superposed with the end 10 of connecting means 11.

As can be seen in FIG. 4*c* showing buffer 44 in place, the later has a slightly greater thickness than that of spacer 40. Thus, top face 45 of the buffer, namely that which is not in contact with connecting means 11, projects with respect to support surface 41 defined by spacer 40.

Figure 5:
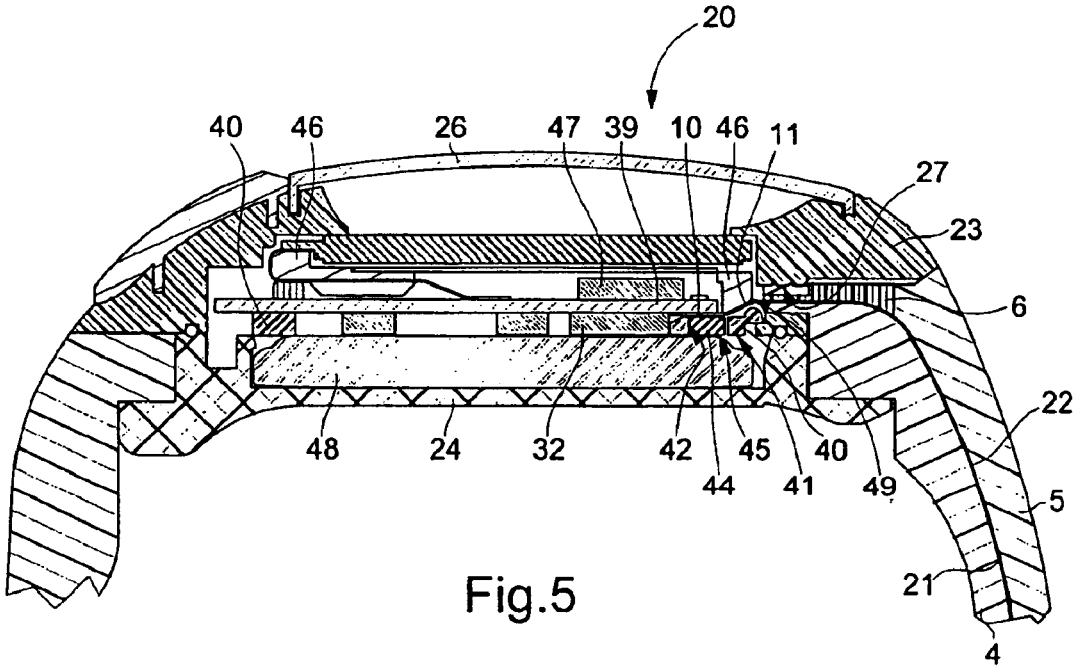
FIG. 5 is a schematic cross-section of the assembled case of the portable device according to the embodiment shown in FIG. 3.

FIG. 5 showing the device that has just been described in cross-section, once back cover 24 has been mounted on middle part 23, allows the function of buffer 44 to be better understood. The general structure shown in FIG. 5 is similar to that shown in FIG. 2, this is why the description of the elements common to these two Figures will not be repeated for FIG. 5.

In this embodiment, under LCD screen 31, there is PCB 39 carrying the electronic components, including the first electric module 32, i.e. here the electronic circuits processing the signals received by antenna 22.

An intermediate spacing element 46 is arranged between LCD screen 31 and PCB 39 to ensure sufficient height between said two elements and to allow components, such as module 47 shown in the figure, to be arranged on PCB 39 in the intermediate space thus defined.

The arrangement of a spacer 40, arranged resting on PCB 39 and wedged transversely by middle part 23, should be noted. Connecting means 11, introduced into case 20 through opening 27 of the middle part, are arranged between spacing element 46 and spacer 40, such that contact pads 43 are arranged facing the corresponding bump contacts 33 of PCB 39. Electrical conduction paths (not shown) are also provided on PCB 39 to electrically connect bump contacts 33 to first electric module 32.

In the portable device shown to illustrate this second preferred embodiment, the power source used is a battery 48 of large diameter. It will be noted that battery 48 is arranged with its first face directly against back cover 24 of case 20, while its second face rests on spacer 40.

Consequently, because the thickness of buffer 44 is greater than that of spacer 40, the second face of battery 48 is also resting on face 45 of the buffer, so as to compress the latter and ensure the electrical contact between contact pads 43 of connecting means 11 and bump contacts 33 of PCB 39.

Thus, the assembling of the portable device according to the present invention can be summarized as follows. Strand 1 is set in place in middle part 23, in which a certain number of components are already mounted, such as LCD screen 31 for example. At the same time, connecting means 11 of antenna 22 are introduced inside case 20. Spacer 40 is arranged in middle part 23, if that has not already been done, then buffer 40 is arranged in its housing 42. Sealing gasket 25, then back cover 24 are mounted on middle part 23, which consequently establishes the electrical connection between contact pads 43 of connecting means 11 and bump contacts 33 of PCB 39. The screws (not shown) securing case 20 are set in place through back cover 24 and strand 1 into middle part 23, thus compressing buffer 44 via battery 48. As buffer 44 is then compressed against PCB 39, connecting means 11 can no longer be disconnected from bump contacts 33 of the PCB.

As regards any replacement of the wristband, or at least of strand 1, one need only unscrew the securing screws from case 20, and remove them at least from holes 7 of strand 1, to relieve the compression of buffer 44 and allow connecting means 11 to be removed from their place. Likewise, in order to reassemble strand 1, it is possible to avoid completely dismantling case 20 to re-establish the electrical connection between the first 22 and second 32 electric modules. Indeed, owing to the structure according to the present invention, it is possible to envisage inserting strand 1 into opening 27 of middle part 23, while sliding end 10 of connecting means 11 into their place. For this purpose, intermediate spacing element 46 can have, in its peripheral region located facing opening 27, a rounded portion 49 to facilitate the sliding of connecting means 11.

Of course, one could, alternatively, locate PCB 39 and bump contacts 33 substantially in the same plane as opening 27, such that end 10 of connecting means 11 does not need to be bent when it is inserted facing bump contacts 33. In such case, rounded portion 49, described hereinbefore, can easily be omitted.

Thus, it is clear that, owing to its structure, the portable device according to the present invention advantageously allows an electrical connection to be established between at least two electric modules without imposing the necessity of providing a specific step for establishing said connection, such as a screwing or welding step, when the device is assembled.

Of course, it is clear that the first and second embodiments that have just been described correspond to structures that are respectively general and particular, explained for non-limiting illustrative purposes.

Once could for example provide electronic circuits generating electric signals sent to the second electric module, such that the portable device according to the present invention is also capable of emitting radiowaves via antenna 22.

It will be understood that various modifications and/or improvements obvious to those skilled in the art can be made to the embodiments described in the present description without departing from the scope of the invention defined by the annexed claims.

What is claimed is:

1. A portable electronic device including a case in which there is arranged a first electric module and a wristband attached to said case, the case including a top portion and a bottom portion which cooperate with each other in order to assemble said case a second electric module being associated with said wristband and electric connecting means providing an electrical connection between said first and second electric modules through an opening made in the case said first electric module including at least one electric bump contact capable of being connected to said electrical connecting means, the assembling of the case establishing an electrical contact via compression, between said connecting means and said bump contact, wherein said case includes means for positioning the angle and height of the first electric module, guaranteeing precise positioning of said bump contact with respect to said opening, arranged on a first of said portions of the case, additional means for positioning the height of the connecting means being arranged on the other of said portions of the case.

2. The devise according to claim 1, wherein it further includes securing a means for holding said bottom and said top together, the implementation of said securing means also being capable of maintaining said electrical contact between the connecting means and said bump contact.

3. The device according to claim 1, wherein it includes first means for ensuring water resistance between said bottom and top portions of said case and wherein said device further includes second means made in a single piece with a constituent element of said wristband and ensuring the water resistance of said case at said opening.

4. The device according to claim 3, wherein said second means include a snug, made of moulded elastic material with a constituent element of said wristband, having slightly greater dimensions than the dimensions of said opening and capable of being deformed to engage by friction in said opening, said snug including a central passage for said electric connecting means.

5. The device according to claim 1, wherein it includes radio frequency type signal reception means, said first electric module including electronic circuits for processing the electric signals received from said second electric module, the latter including an antenna capable of at least receiving radio frequency type signals, said connecting means including in particular two electric conductors respectively connected to a first and a second end of said antenna, said first electric module including at least two bump contacts intended to be contacted by said connecting means.

6. The device according to claim 5, wherein said second electric module further includes means for communicating with the external environment, said connecting means including additional conductors for providing an electrical connection between said communication means and said first electric module.

7. The device according to claim 6, wherein said communication means include a charging coil capable of inducing an electric current between its terminals by interacting with an external charger.

8. The device according to claim 1, wherein it further includes an element made of elastic material capable of compressing said connecting means against said bump contact when the case is assembled.

9. The device according to claim 8, wherein said element is a buffer of substantially parallelepiped shape and whose face that will come into contact with said connecting means has a surface area at least equal to the surface area of said bump contact.

10. The device according to claim 8, wherein it includes radio frequency type signal reception means, said first electric module including electronic circuits for processing the electric signals received from said second electric module, the latter including an antenna capable of at least receiving radio frequency type signals, said connecting means including in particular two electric conductors respectively connected to a first and a second end of said antenna, said first electric module including at least two bump contacts intended to be contacted by said connecting means.

11. The device according to claim 8, wherein it includes an additional element having positioning means with respect to the case and including a housing for receiving said element made of elastic material.

12. The device according to claim 11, wherein said additional element is a spacer for positioning the height of said first electric module with respect to the other of said portions of the case.

13. The device according to claim 11, wherein it includes radio frequency type signal reception means, said first electric module including electronic circuits for processing the electric signals received from said second electric module, the latter including an antenna capable of at least receiving radio frequency type signals said connecting means including in particular two electric conductors respectively connected to a first and a second end of said antenna said first electric module including at least two bump contacts intended to be contacted by said connecting means, and wherein said first electric module includes a printed circuit board carrying said bump contacts and said electronic circuits, said printed circuit board having at least one region arranged in contact with said spacer.

14. The device according to claim 13, wherein said second electric module further includes means for communicating with the external environment, said connecting means including additional conductors for providing an electrical connection between said communication means and said first electric module.

* * * * *